United States Patent [19]

Adessi

[11] Patent Number: 5,011,140

[45] Date of Patent: Apr. 30, 1991

[54] MULTI-PURPOSE SAFETY EXERCISE APPARATUS

[76] Inventor: Alfred A. Adessi, 2129 NE. 44th St., Fort Lauderdale, Fla. 33308

[21] Appl. No.: 586,428

[22] Filed: Sep. 21, 1990

[51] Int. Cl.[5] ..... A63B 21/062; A63B 21/00; A63B 21/06

[52] U.S. Cl. ..... 272/118; 272/117; 272/134

[58] Field of Search ..... 272/117, 118, 134, 144, 272/123

[56] References Cited

U.S. PATENT DOCUMENTS

| | | | |
|---|---|---|---|
| 4,357,010 | 11/1982 | Telle | 272/118 |
| 4,722,522 | 2/1988 | Lundgren | 272/117 |
| 4,949,951 | 8/1990 | Devler | 272/134 |
| 4,974,835 | 12/1990 | Klink | 272/123 |

FOREIGN PATENT DOCUMENTS

| | | | |
|---|---|---|---|
| 2162433A | 2/1986 | United Kingdom | 272/134 |
| 2170413A | 8/1986 | United Kingdom | 272/118 |

*Primary Examiner*—Richard J. Apley
*Assistant Examiner*—Karen G. Horowitz
*Attorney, Agent, or Firm*—Malin, Haley, McHale, DiMaggio & Crosby

[57] ABSTRACT

A multi-purpose exercise apparatus for safely performing weight lifting exercises (such as free weights) that eliminates the need for an assistant comprising a bench that is supported on the floor at both ends, one end of which is pivotally anchored to an elongated U-shaped weight supporting frame which encompasses and surrounds the supported bench. The U-shaped frame further includes a vertical support that is attached to a positionable weight lifting handle bar. Free weights are mounted on each side of the movable end of the U-shaped frame. Because of the length of the longitudinal side members of the U-shaped frame extending from one end of the exercise bench to the opposite end, the path of the handle bars is essentially linear. The apparatus provides for maximum efficiency and safety in bench pressing, squatting and other free weight exercises.

1 Claim, 4 Drawing Sheets

MULTI-PURPOSE SAFETY EXERCISE APPARATUS

BACKGROUND OF THE INVENTION

1. Field of the Invention

This invention relates generally to an apparatus for performing a variety of different weight lifting exercises safely, and specifically to a multi-purpose weight lifting exercise apparatus that allows one to perform at home a full range of weight lifting exercises safely without an assistant with the same muscle resistance provided as would be achieved in free weight lifting.

2. Description of the Prior Art

Bench pressing and other exercises with free weights can be dangerous. If the lifter tires or suffers an injury or a hand slips, the weights can be dropped unexpectedly causing injury to the weight lifter or bystander. An assistant is normally employed to prevent the dropping of the weights. The prior art shows a plethora of exercising devices. Many employ numerous pulleys and cables which can snap or break loose. Others show beam and levers that are complex in construction and operation. U.S. Pat. No. 4,598,907 issued to Ross, July 8, 1986, shows a weight platform suspended with flexible lines adjacent a bench surface. U.S. Pat. No. 4,357,010 issued to Telle, Nov. 2, 1982, shows a double beam arrangement with a weight bar supported on shock absorbing rests. U.S. Pat. No. 4,344,619, issued to Szabo, Aug. 17, 1982, discloses a pivoted weight lifting apparatus in which one end is attached to a wall with the weights themselves being attached near the handle member. U.S. Pat. No. 4,406,452, issued to Lapcevic, Sept. 27, 1983, shows a beam member pivotally supported at one end with the weights attached near the bar a significant distance from the supporting floor. U.S. Pat. No. 4,407,495, issued to Wilson, Oct. 4, 1983, shows a levered bar mechanism that includes flexible lines that attach to the lever mechanism. U.S. Pat. No. 4,757,998, issued to Landin, July 19, 1988, shows a safety device for a weight training bench which provides a bar-type shield over the body of the user.

These devices did not provide for the total safety of the user in that the weights and lift bars are positioned relative to the user such that in the event of a mechanical failure or the like the user could be injured. The present invention provides a multipurpose exercising device that can be used for safely lifting weights in a variety of different exercises including squats and bench presses which because of the particular weight support configuration the weight lifting handle can be safely dropped.

SUMMARY OF THE INVENTION

A safety exercising device for weight lifting to provide a variety of different weight lifting exercises that simulates the muscle resistance of free weights safely and efficiently without the need for an assistant.

The device is comprised of a padded bench horizontally supported by a pair of vertical posts, each terminating in a floor engaging stabilizing bars. A rigid horizontally disposed metal tube is connected to the padded bench and at each end to the vertical posts. At the rear end of the device, the vertical support post terminates at the floor in a flat, arcuate shaped floor stabilizer bar extending laterally away from the bench on both sides. The ends of the arcuate floor stabilizer bar include pivotal joint connections to which a U-shaped tubular frame, extending from the rear of the device at the connection to a line beyond the padded bench, is pivotally connected. The U-shaped bar is comprised of parallel longitudinally disposed tubular frame members connected laterally by a tubular frame cross member substantially past the end of the bench. The tubular frame cross member includes a vertical post to which a weight lifting handle is attached and which is used to lift free weights mounted on the end corners of the U-shaped tubular frame by rigid vertical upright weight holders. The corners of the U-shaped frame also includes a pair of floor engaging pillow blocks mounted underneath the weight holders so that the entire Ushaped frame is supported above the floor a few inches. The cross frame member also includes a floor engaging block mounted beneath the vertical post supporting the weight lifting handle for additional support.

The rear vertical post that supports the bench may also include a secondary exercise device comprised of frame members pivotally attached to the vertical post that includes a weight holding rod and lateral handles for foot engagement while positioned on the bench.

Referring again to the U-shaped frame, the weight lifting handles are attached to a vertical telescopically adjustable post which is affixed to the middle of the lateral frame member of the U-shaped frame. The weight lifting handles can be adjusted vertically to accommodate different exercises and different sized persons by selecting certain apertures and support pins in the vertical post sections.

The U-shaped frame is sufficiently long (extending from the rear of the device past the bench) to permit a very small angular motion path of the lateral end of the frame when weights are lifted by moving the weight lifting handles so that any particular exercise being performed ensures that muscle extension will be in the correct direction, closely duplicating free weight lifting.

The safety of the device is realized by several structural features. The weight lifting handle is a U-shaped bar that extends away from the body when in use. The weights are relatively low to the ground in the extended raised position during the exercise and are located completely away from the body of the person using the exercise device. The elongated U-shaped frame is located low and away from the users body and acts to rigidly stabilize the weights in position in a location that prevents injury during any type of exercise selected. For example, the weight lifting handle can be positioned so that the user stands at the front end of the device, facing the device (not using the bench) to perform shoulder presses or other types of weight lifting presses. The weights and device elements are completely positioned away from the user except for the weight lifting handle. The U-shaped frame that houses the weights is also supported several inches above the floor to prevent the frame members from being being dropped on a person,s foot since there is sufficient clearance beneath the U-shaped frame members to permit the height of a foot.

When using the bench for bench presses and the like, the weight lifting handle is conveniently and easily positioned for maximum efficient muscle resistance from the bench position with the weights and other peripheral equipment being spaced laterally away from the user so that again the elongated frame members of the U-shaped frame pivot in a relatively shallow arc to provide maximum muscle resistance and natural extension while at the same time being maintained below and away from the user laterally and longitudinally for maximum safety.

It is an object of this invention to provide an improved weight lifting exercise apparatus to provide a multiple variety of weight lifting exercises safely without detracting from the efficiency and weight resistance presented.

It is another object of this invention to provide an improved weight lifting apparatus which is low cost and non-complex in construction which positions the weights and supporting equipment in locations for maximum safety while obtaining maximum natural muscle extension.

And yet another object of this invention is to provide a weight lifting device that permits the user to achieve proper muscle extensions that most naturally conform to proper muscle extensions while doing so in a safe and efficient manner.

Yet still another object of this invention is to provide a weight lifting apparatus that includes an extended longitudinal weight support frame for maximum safety of the user and which does not require an assistant for safe operation and weight lifting.

In accordance with these and other objects which will be apparent hereinafter, the instant invention will now be described with particular reference to the accompanying drawings.

PREFERRED EMBODIMENT OF THE INVENTION

Figure 1:
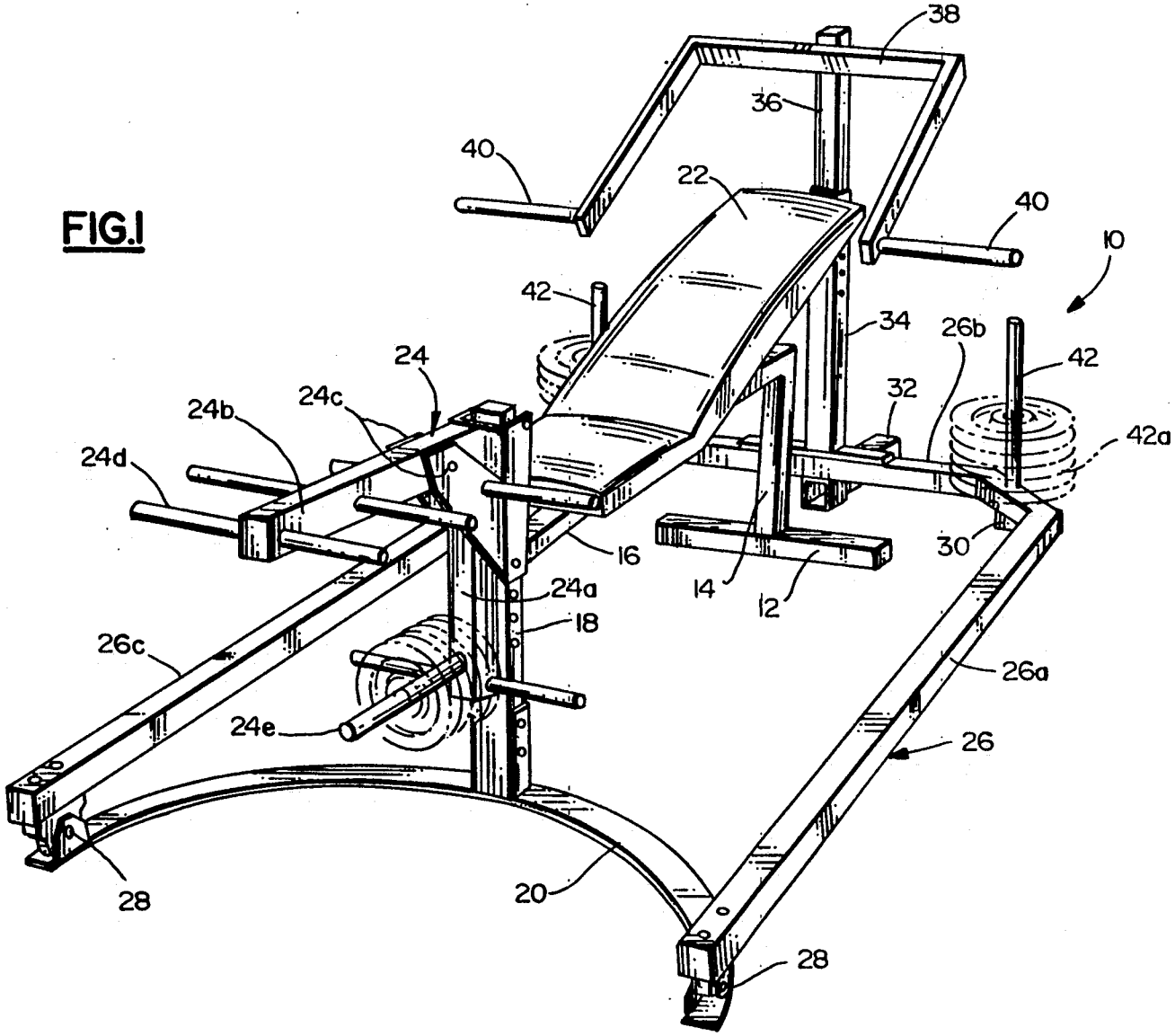
FIG. 1 shows a perspective view of the present invention.

Referring now to the drawings and specifically to FIG. 1, the present invention is shown generally at 10 comprised of an adjustable padded bench 22 mounted firmly on horizontal frame member 16 which is supported at one end (front) by a vertical post 14 connected to a floor engaging member 12 and at its opposite end (rear) by a vertical post 18 connected to a flat arcuate floor engaging stabilizing bar 20 which extends laterally and longitudinally toward the rear of the device for stabilizing support. Pivotally attached to the rigid bar 20 by engaging pins 28 is an elongated rigid metal frame 26 that is U-shaped and is comprised of two longitudinally disposed frame members **26*a* and 26*c* which are rigidly connected to a transverse frame member 26*b* at the front end of the device. Also attached to the rigid lateral frame member 26*b* is a vertical support member 34 which telescopically encompasses rigid vertical support member 36 which is adjustably connected to a U-shaped weight lifting bar 38 and the weight lifting handles 40**.

A pair of weight receiving bars 42 are vertically mounted at the transverse ends of lateral frame member **26*b* and receive a plurality of free weights 42*a* (shown in phantom) to provide for adjusting the amount of weight sizes as desired. Located beneath the weight receiving bars 42 are a pair of floor engaging frame supports 30 which support the U-shaped frame 26 the same distance off the ground as the pivotal connections 28 at the rear end of the device. Also supporting the U-shaped frame is a cross member support 32 horizontally disposed and connected at the bottom of support member 34 for providing additional stability and support to the device. Note that the padded bench 22 is completely supported independently of the moveable U-shaped frame 26**.

The U-shaped frame members **26*a* and 26*c* run the full length of the device and extend past the bench pad 22 longitudinally to provide a very small arc when the weight handles 40 are actuated by the user for lifting the weights 42*a* greatly reducing the arcuate movement (curvature) of the handles 40**. This ensures the maximum natural extension of the user's arms and limbs in a straight line motion.

The primary use of the system is through the use of weights **42*a* actuated by lifting handles 40. A secondary weight system using weights mounted on bar 24*e* is provided at the rear end of the device which allows for additional exercise be performed from the bench through the pivotal action of auxiliary weight system 24. The weight system 24** is described in greater detail below.

Figure 2:
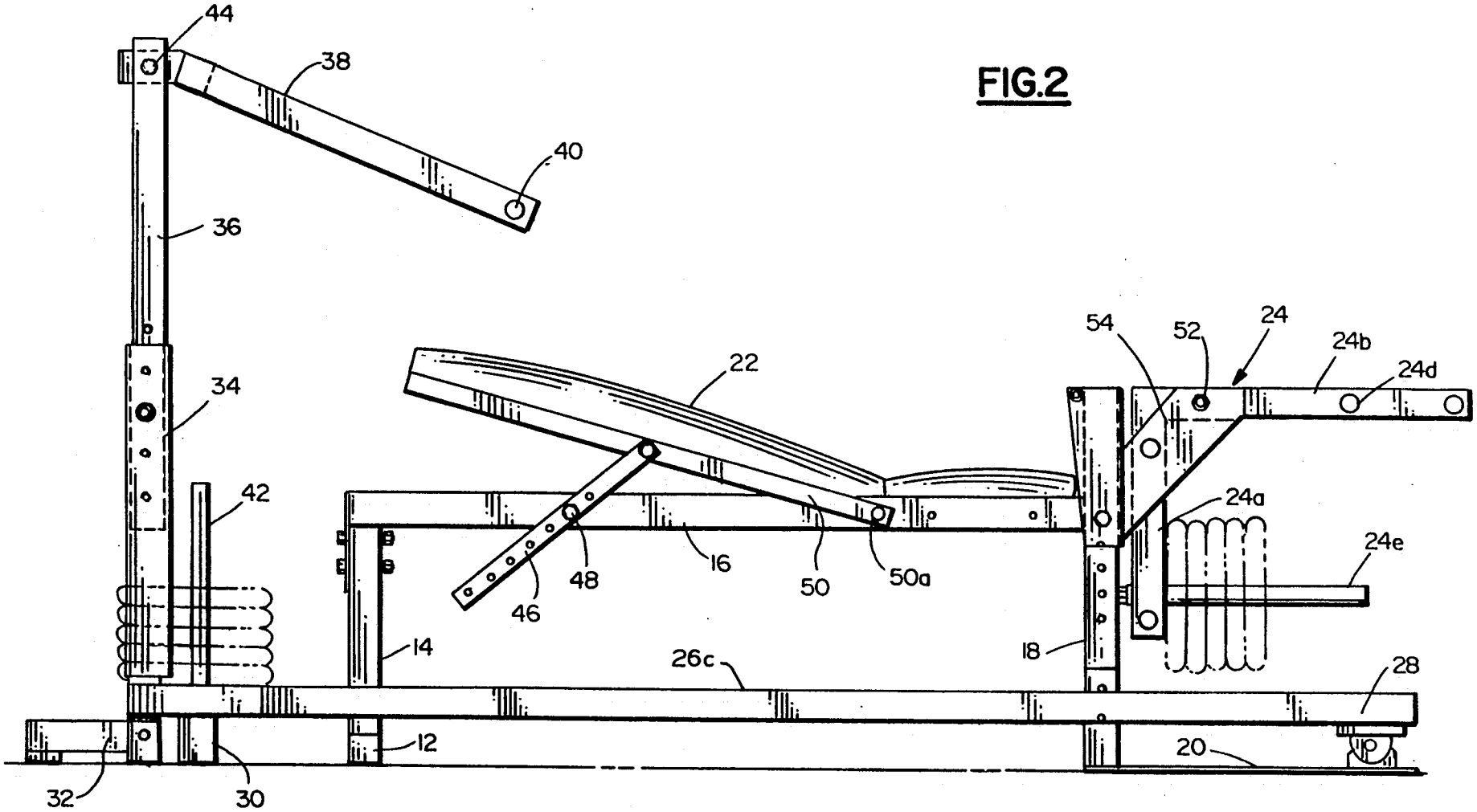
FIG. 2 shows a side elevational view of the present invention with the weights being in the non-operated rest position.

Referring now to FIG. 2 the invention is shown with the padded bench 22 suspended and connected adjustably to the horizontal frame member 16 such that the bench 22 can be moved by adjustment of arm 46 with anchor pins 48 rigidly connected to bar 16 so that it can be raised or lowered appropriately. Bar 50 is pivotally attached to the frame member 46 by pin **50*a*** on each side.

The elongated frame member **26*c* is connected at the rear of the device to a pivoting joint mechanism that includes a clevis mounting and a pivot pin 28 elevated a few inches off the floor above the rear supporting bar 20**. This is to ensure that the feet of someone standing adjacent the device will be protected from any type of accidental movement of the weight lifting U-shaped frame so that the feet will not be caught beneath the weight lifting portion. Thus the lateral areas of the device are safe.

FIG. 2 also shows the secondary weight lifting system 24 which includes support bar **24*a* perpendicularly connected to bar 24*b* and includes limb engaging extensions 24*d* and a pivot mechanism 52 that mounts the entire unit 24 on an extending connecting member on each side 54 which is firmly connected to the vertical support member 18. A plurality of free weights may be mounted on the weight mounting rod 24*e*** such that the unit rotates pivotally as is discussed below.

Figure 4:
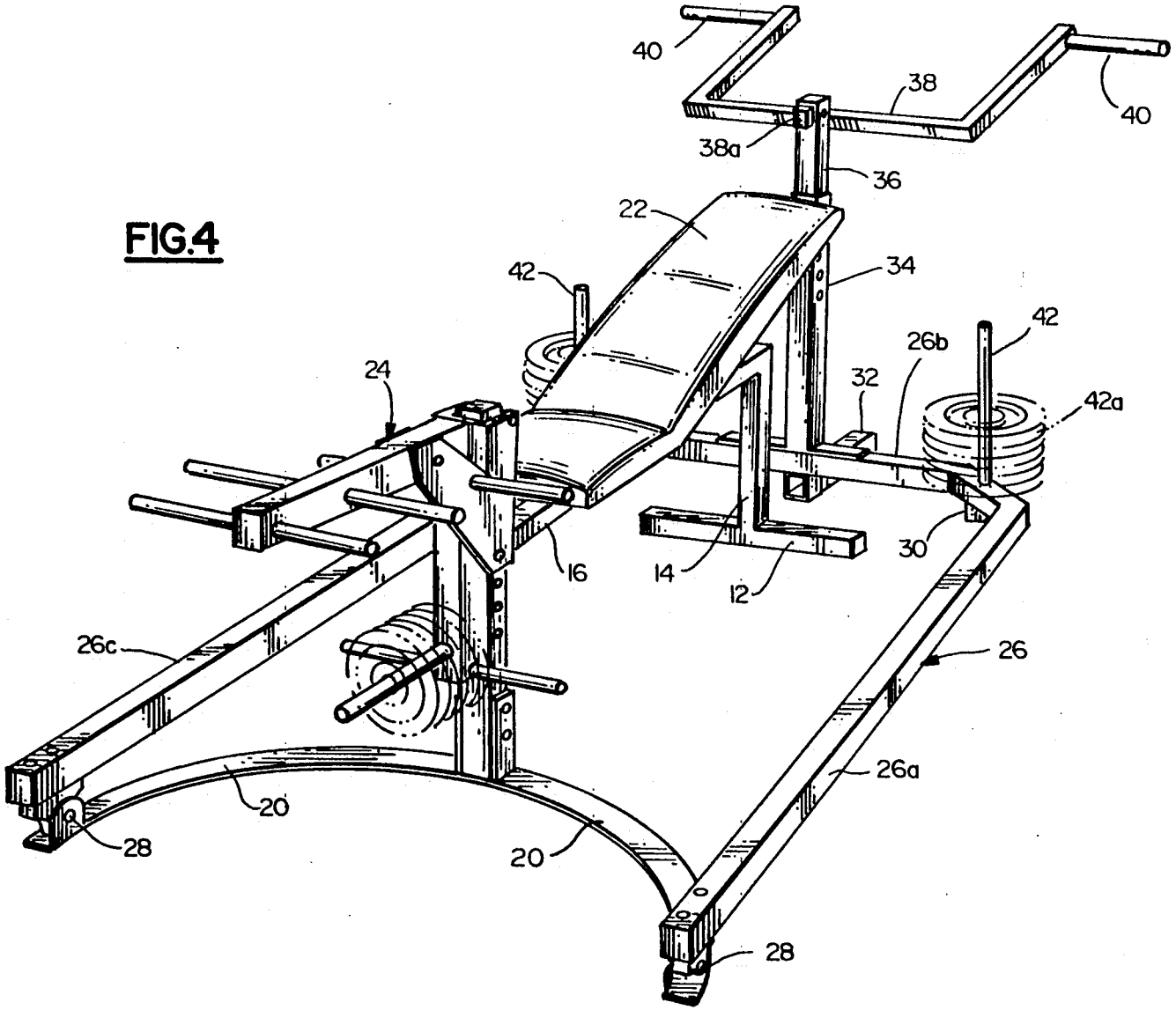
FIG. 4 shows a perspective view of the invention with the weight lifting bar handle moved to a position so that the user may stand at one end of the device facing the device for operating the device.

In the forward end of the device, the weight handles 40 are adjustable in height and position through the use of the telescopic vertical frame members 34 and 36 and an adjustable connector pin 44 mounted at the top of vertical frame member 36. The weight handles 40 and the weight lifting bar 38 may be rotated at least 180 degrees so that the entire weight handle is on the opposite side of vertical support member 36 as is shown in FIG. 4. This allows the user to be positioned in front of the device at the forward end of the device facing the device to perform weight lifting exercises while seated on a bench (not shown) or from a standing position. Note, in this position, the user is completely removed from the weight lifting frame members and weights in an extremely safe position so that free weights can be safely lifted without the use of a spotter or assistant. Should the user tire while lifting, the weights can be dropped without any danger of bodily injury to the user. The weights themselves have just a short distance of travel to the floor.

Figure 3:
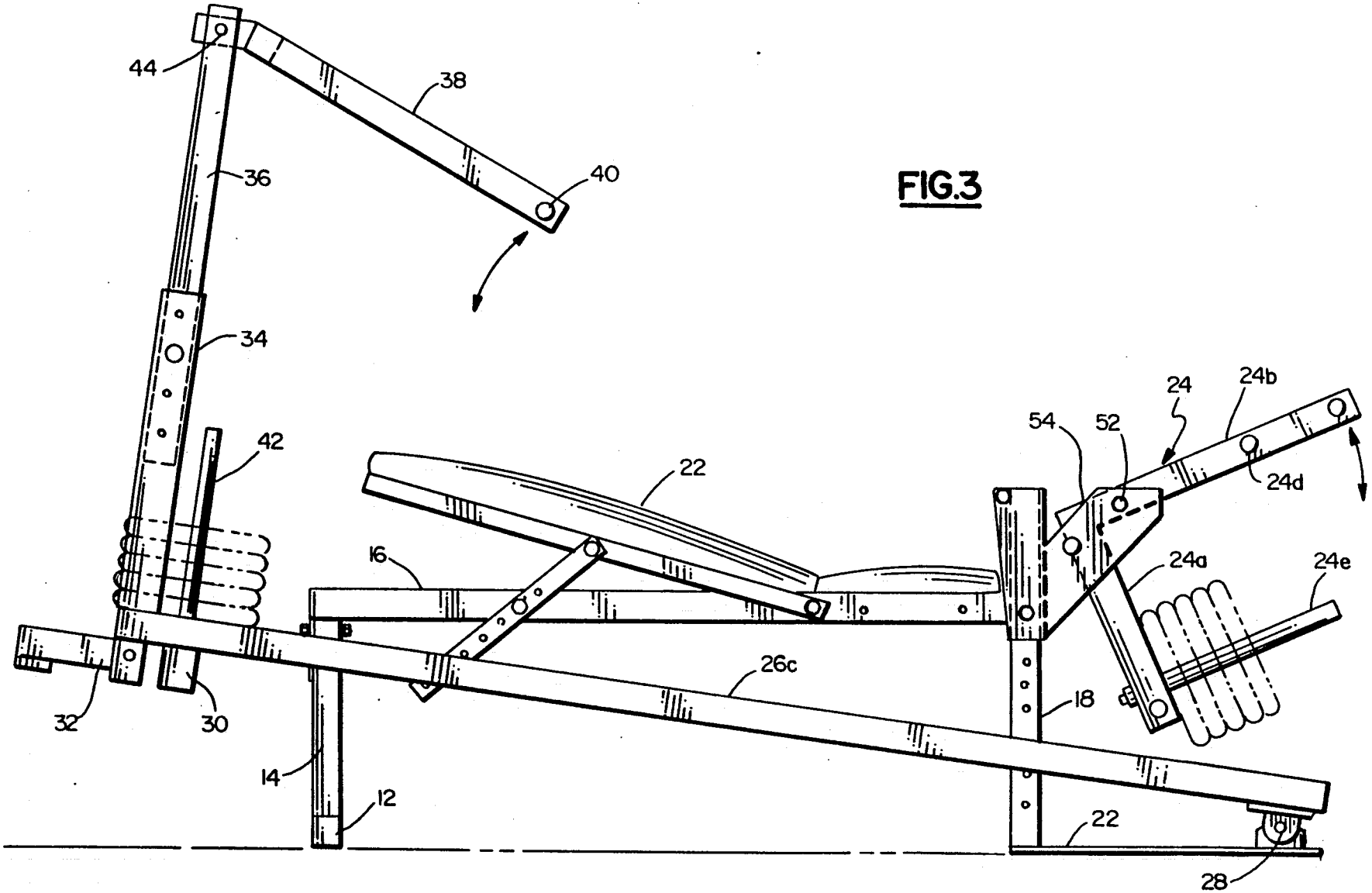
FIG. 3 shows a side elevational view of FIG. 2 which shows the U-shaped platform in a raised position and the auxiliary weight lifting component in one end also in a raised position.

Referring now to FIG. 3, both the primary and secondary weight systems are shown in a raised or extended position. Specifically the U-shaped frame 26 is shown in a raised position on the floor as would be the case while the user is lifting the primary weights on bar 42 either from the bench 22 or as described above if the weight handles 40 are in the opposite position with the user in front of the device facing the device. Note that when the U-shaped frame members 26c are in the raised position, the support beams and related components for raising and lowering the weight frame support members are safely positioned from the user's body regardless of the particular exercise. Note also the shallow acute angle formed by the floor support member 22 and the elongated frame member 26c . At the maximum lift position, the weights 42a on the weight retaining rod 42 are near the floor.

FIG. 3 also shows the secondary exercise component 24 in a raised position including support frame members 24a and 24b perpendicularly joined together and the weight mounting rod 24e, all of which is pivotally connected to pin 52 supported by rigid frame member 54.

Referring now to FIG. 4, the invention is shown with the weight lifting handles 40 moved to a forward extending position by adjustable member 38a which connects the weight lifting handle bar 38 (which is U-shaped for safety) to the vertical support member 36. Thus with the handles 40 in this position, the user can perform several different weight lifting exercises at the forward or front end of the device while being completely removed from the weight lifting equipment and the frame members for added safety.

One of the advantages of the present invention is that since free weights can be lifted safely without an assistant, the apparatus is particularly suited for home use. Other advantages are its non-complex construction and the fact that it does not take up a significant amount of space. The device is capable of being used for essentially all types of free weight lifting exercises including bench presses and squats. The muscle resistance provided is equivalent to the use of a barbell, but much safer while eliminating the need for an associate or assistant.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A safety weight lifting exercising apparatus which provides for free lift weight resistance without requiring an assistant comprising:

a padded elongated bench;

a rigid horizontal first frame support member connected to said bench;

first vertical support member connected to one end of said horizontal support member;

first horizontally disposed floor support member connected to said first vertical support member;

second vertical support member connected at the opposite end of said first horizontal support member;

second horizontally disposed floor support member connected to said second vertical support member;

a horizontally disposed U-shaped rigid support frame pivotally connected at the free ends of said U-shape to said second floor support, said U-shaped frame including a pair of elongated parallel frame members disposed parallel to said bench, and extending in length past the end of said bench, and a U-shaped transverse support frame member connecting said elongated frame members at the base of said U-shape and situated near a user's upper body;

a third vertical support member connected to a central point of said U-shaped transverse frame member;

a weight lifting handle connected to one end of said third vertical support member;

a set of weights;

a pair of weight receiving rods vertically disposed on each side of the ends of said U-shaped transverse frame member for receiving said weights; and supporting means mounted to bottom side of said U-shaped transverse frame member for elevating said frame above the ground in the down position;

whereby, upon raising said weight lifting handle, the U-shaped frame is pivoted upwards and said weights on said weight receiving rods are also lifted.

* * * * *